US007226347B1

(12) United States Patent
Padgett et al.

(10) Patent No.: US 7,226,347 B1
(45) Date of Patent: Jun. 5, 2007

(54) WALK BEHIND POLISHER

(75) Inventors: Stephen David Padgett, Powell, TN (US); Thomas Roy Lively, Andersonville, TN (US)

(73) Assignee: CPT, Inc., Norris, TN (US)

( * ) Notice: Subject to any disclaimer, the term of this patent is extended or adjusted under 35 U.S.C. 154(b) by 0 days.

(21) Appl. No.: 11/327,860

(22) Filed: Jan. 9, 2006

(51) Int. Cl.
*B24B 23/00* (2006.01)

(52) U.S. Cl. ..... 451/353; 451/359

(58) Field of Classification Search ..... 451/344, 451/350–353, 359, 360, 451, 352; 15/49.1, 15/52, 98
See application file for complete search history.

(56) References Cited

U.S. PATENT DOCUMENTS 5,637,032 A 6/1997 Thysell et al.
5,863,241 A * 1/1999 Rottschy ..... 451/271
6,238,277 B1 * 5/2001 Duncan et al. ..... 451/271
6,331,138 B1 12/2001 Witters et al.
6,540,596 B1 * 4/2003 Van Der Veen ..... 451/350
6,783,447 B2 * 8/2004 Van Vliet et al. ..... 451/353
2004/0077300 A1 * 4/2004 Thysell et al. ..... 451/350

* cited by examiner

*Primary Examiner*—Dung Van Nguyen
(74) *Attorney, Agent, or Firm*—Pitts & Brittian PC

(57) ABSTRACT

An improved walk behind polisher and grinder is disclosed. The improved walk behind polisher and grinder provides a surface polishing machine capable of operation with increased directional stability and reduced dust accumulation to the essential internal components of the machine. The improved walk behind polisher and grinder includes a drive motor mounted on a frame. The drive motor rotates a central shaft, and the central shaft supports a belt pulley and a rotary housing. The belt pulley mechanically communicates with at least one pinion shaft through an endless drive. Each pinion shaft is mechanically engaged by an internal gear such that rotation of the central shaft causes the pinion shaft to rotate about their own axes in a given direction and to revolve around the central shaft in the opposite direction.

13 Claims, 4 Drawing Sheets

WALK BEHIND POLISHER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to surface polishing machines. More particularly, this invention pertains to an improved surface polishing and grinding machine for conducting various surface polishing operations such as scrubbing, buffing, grinding, or polishing of floor surfaces or similar, essentially continuous surfaces.

2. Description of the Related Art

It is often necessary to sand, polish, or otherwise refinish flooring surfaces such as concrete, stone, or other such flooring surfaces. The conventional tool used in performing this type of surface polishing is a hand operated polishing machine. This type of machine typically utilizes surface processing apparatus including at least one frictional surface rotated by an electric motor, a combustion engine, or similar power means. Conventionally, the machine includes a handle, and a user operates the machine by walking behind the machine, pushing the handle and manually directing the surface processing apparatus across the flooring surface.

In a typical surface polishing machine, the frictional surface rotates in a circular direction relative to the working surface. As a result of this circular rotation, the various components of such typical surface polishing machine are prone to experience significant inertial forces. The forces developed by typical circular rotation pose considerable risks of uncontrolled movement in the surfacing machine, with an associated reduction in processing capacity and an increased wear on the frictional surface. Thus, the operator of a typical surface polishing machine must be trained and experienced in handling such machine, in order to be able to minimize the risks of excess uncontrolled movement of the surface polishing machine.

Furthermore, there has been a perennial problem associated with most surface polishing operations, and even more so with surface polishing operations that are conducted using high speed mechanical equipment. The material that is removed from the finished surface is given off in the form of dust. In large scale surface polishing operations, using high speed mechanical equipment, a large quantity of dust is generated which accumulates within the surface polishing machine and interferes with the internal components of the surface polishing machine.

BRIEF SUMMARY OF THE INVENTION

An improved walk behind polisher and grinder with increased directional stability and reduced dust accumulation to the essential internal components of the machine is disclosed. The improved walk behind polisher and grinder includes a drive motor carried by a frame. The drive motor rotates a central shaft, and the central shaft is fixed to a belt pulley. A rotary housing is rotatably mounted to the central shaft, and the belt pulley is disposed within the rotary housing. The rotary housing is adapted to receive at least one pinion shaft. Each pinion shaft is rotatably mounted to the rotary housing. An internal gear is fixed to the frame in mechanical engagement with each pinion shaft such that rotation of the central shaft causes the pinion shaft to rotate about its own axis in a given direction and to revolve around the central shaft in the opposite direction. A polishing plate or other surface work tool is fixed to each pinion shaft such that rotation of the pinion shaft causes rotation of each polishing plate. The polishing plates contact and apply frictional force to a working surface to effect polishing of the working surface. Suitable surface work tools include any item that is attached to a mounting plate that fulfills the functions including scrubbing, buffing, grinding, or polishing of floor surfaces or similar, essentially continuous, surfaces.

In order to minimize exposure of the internal gear to dust from the working surface, a baffled wall is provided. The baffled wall includes a bushing defined by a substantially cylindrical wall substantially surrounding the internal gear, and a brush ring substantially surrounding the bushing. In one embodiment, the bushing is fixed to the rotary housing, and the brush ring is attached to the frame. In another embodiment, the brush ring is fixed to the rotary housing, and the bushing is attached to the frame. The brush ring is equipped with a plurality of bristles which contact the bushing. As the upper surface of the rotary housing rotates proximate the frame, the bushing rotates proximate the brush ring. This causes the bristles to effectuate brushing of the bushing, limiting the exposure of the internal gear to dust from the working surface.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

An improved walk behind polisher and grinder is disclosed. The improved walk behind polisher and grinder, illustrated at 10 in the figures, provides a surface polishing machine capable of operation with increased directional stability and reduced dust accumulation to the essential internal components of the machine.

Figure 1:
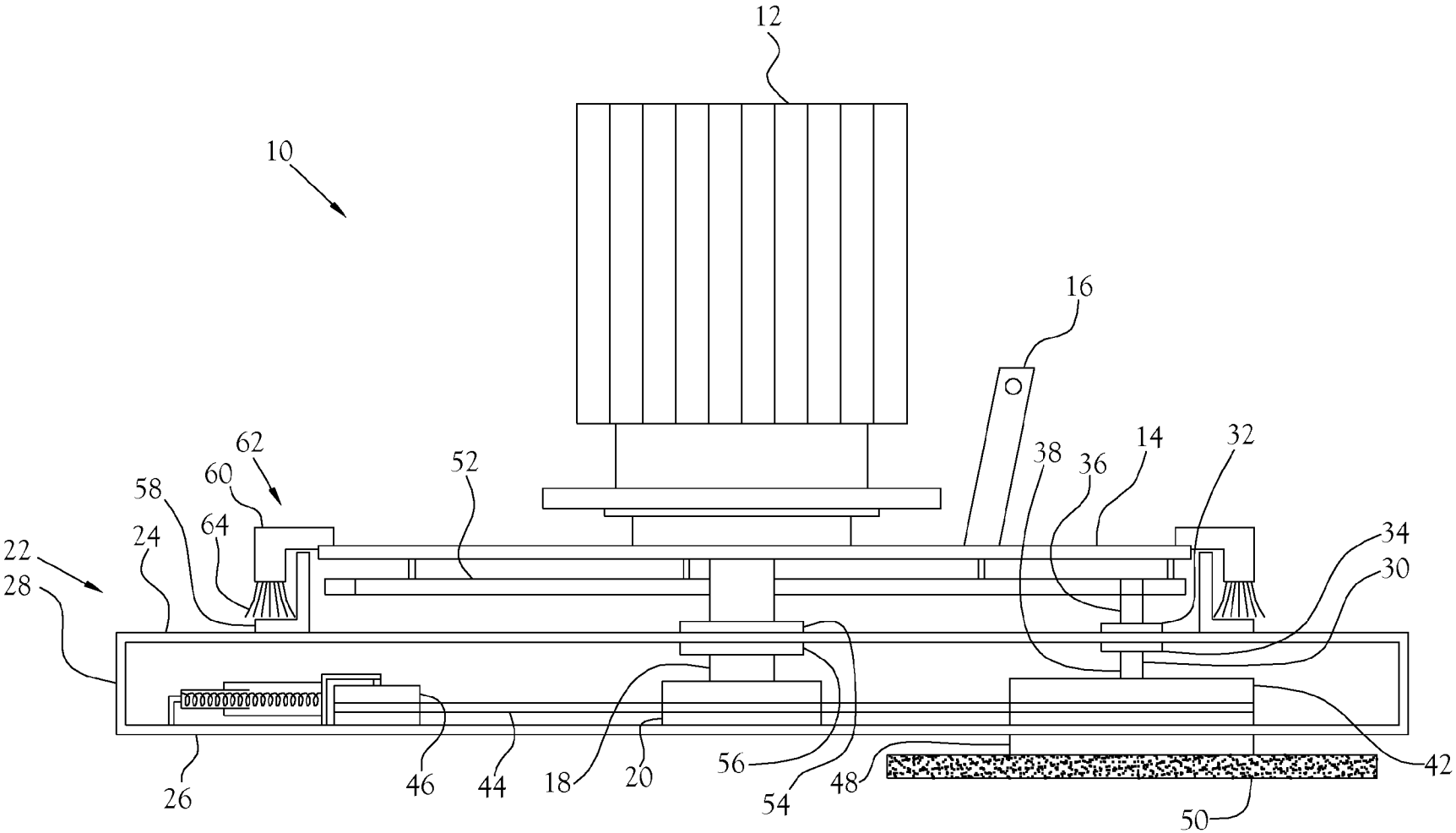
FIG. 1 is a cross-sectional view in schematic form of an improved walk behind polisher and grinder constructed in accordance with several features of the present invention.

FIG. 1 is a cross-sectional view in schematic form of an improved walk behind polisher and grinder 10 constructed in accordance with several features of the present invention. The simplified schematic does not illustrate various connections, for example, power and ground connections to the various components; however, those skilled in the art will recognize the need for such wiring and understand how to wire such a circuit, based on the components ultimately selected for use. The improved walk behind polisher and grinder 10 includes a drive motor 12 mounted on a frame 14. The frame 14 is provided with attachment members 16 for control devices not shown in the drawing, by means of which a user can move the machine over a working surface. The drive motor 12 rotates a central shaft 18, and the central shaft 18 supports a belt pulley 20 and a rotary housing 22. The rotary housing has the form of a flat substantially cylindrical container with an upper surface 24 and a lower surface 26 connected together by means of a substantially cylindrical wall 28. The belt pulley 20 is contained within the rotary housing 22. The belt pulley 20 is fixed to the central shaft 18 such that rotation of the central shaft 18 causes rotation of the belt pulley 20. The rotary housing 22 is rotatably mounted to the central shaft 18 by associated bearings 54, 56 which allow free rotation of the rotary housing 22 about the axis of the central shaft 18.

Figure 2:
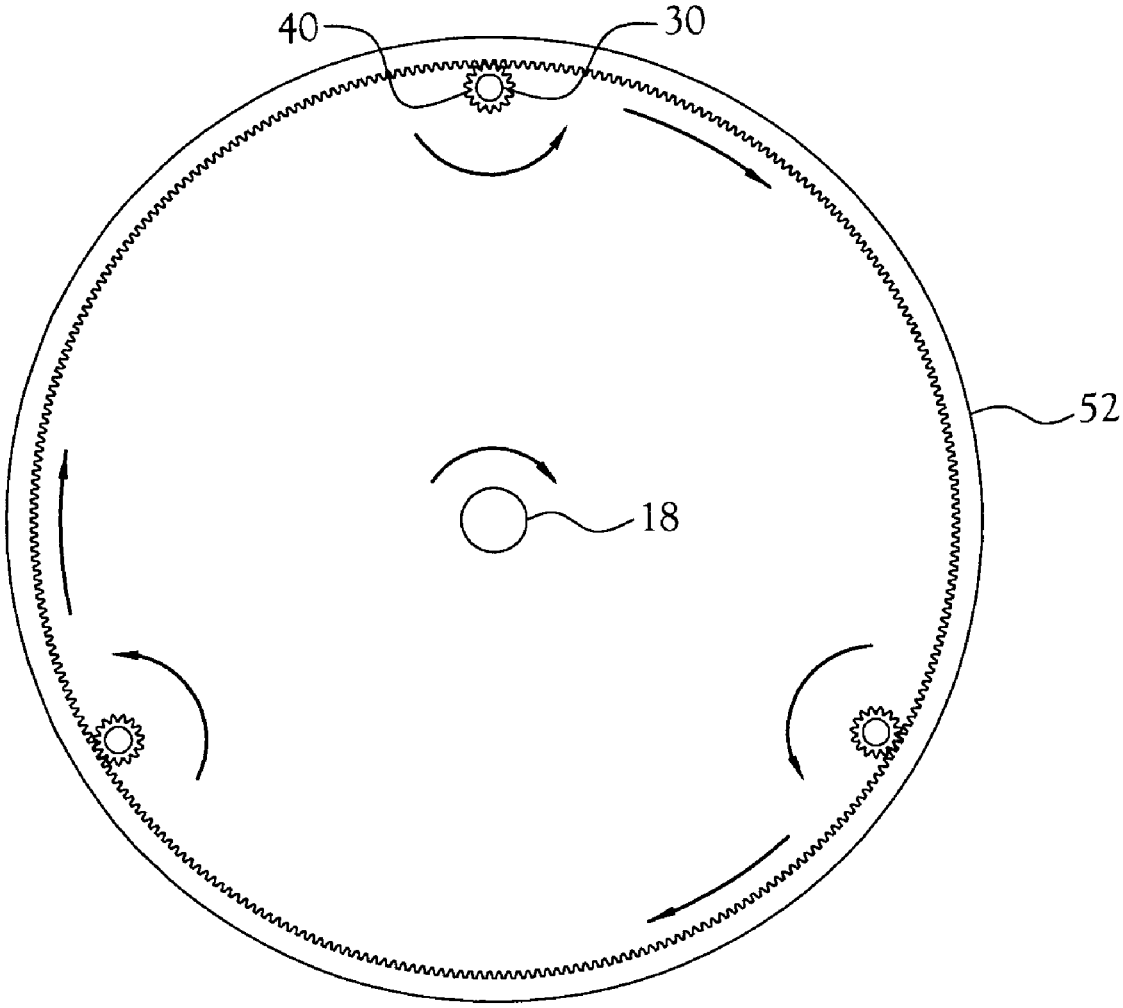
FIG. 2 is a cross-sectional plan view of the improved walk behind polisher and grinder, taken along 2—2 of FIG. 1.
Figure 4:
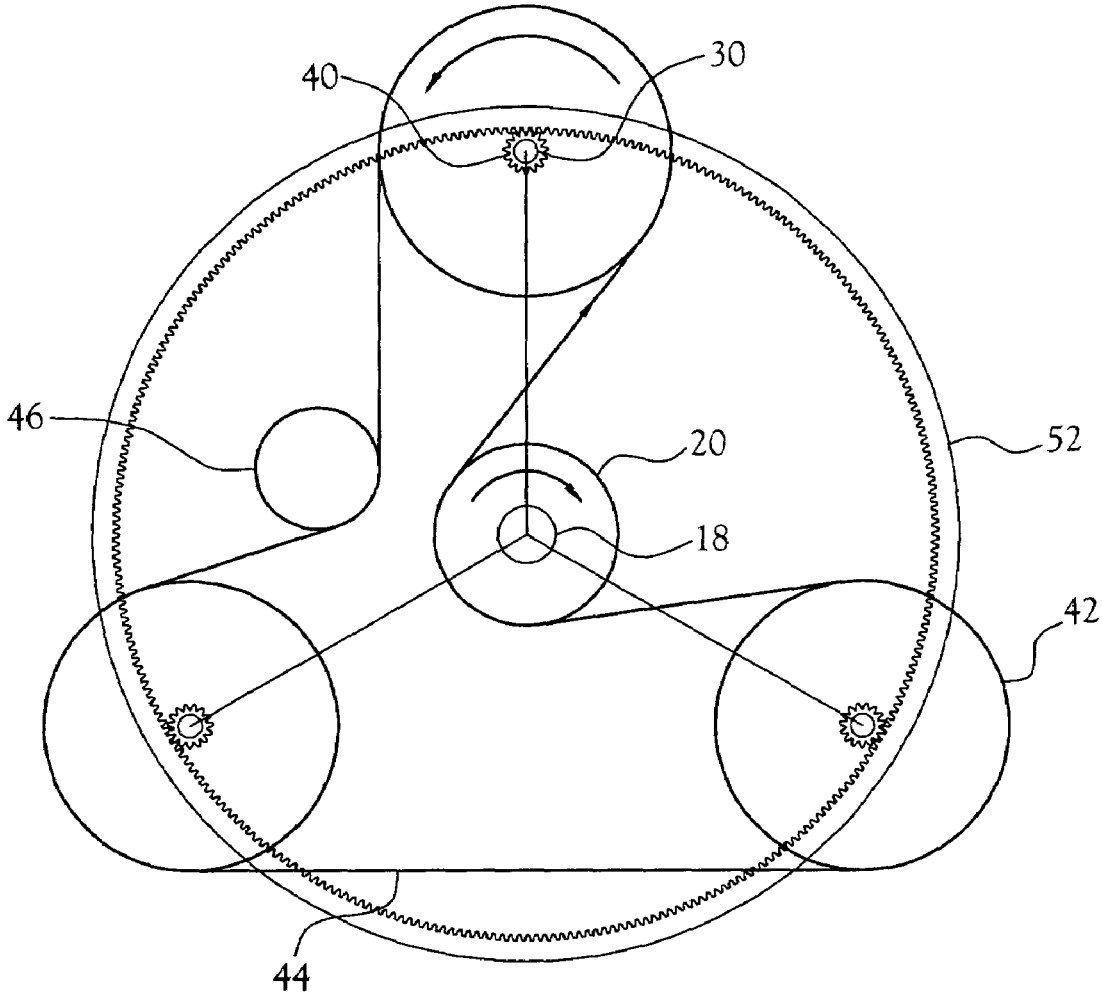
FIG. 4 is a plan view of the improved walk behind polisher and grinder, showing various internal components in phantom.

The upper surface 24 of the rotary housing 22 is adapted to receive at least one pinion shaft 30, each pinion shaft 30 having a first end 36, and a second end 38. Each pinion shaft 30 is rotatably mounted to the upper surface 24 by means of a plurality of bearings 32, 34 to allow free rotation of the upper surface 24 about the axis of the pinion shaft 30. A pinion 40 (as shown in FIG. 2 and FIG. 4) is fixed to each pinion shaft 30 proximate the pinion shaft first end 36, and a disk pulley 42 is fixed to each pinion shaft 30 proximate the pinion shaft second end 38.

At least one mounting plate 48 is adapted to be received by the lower plate 26, proximate each disk pulley 42. A polishing plate 50 is received by each mounting plate 48. The polishing plates 50 contact and apply frictional force to a working surface (not shown) to effect polishing of the working surface. In the present embodiment, each mounting plate 48 serves both to secure the lower plate 26 to the cylindrical wall 28 and to fix the polishing plate 50 to its cooperating pinion shaft second end 38.

Those skilled in the art will recognize other methods and configurations to attach the lower plate 26 to the cylindrical wall 28 and to ultimately fix the polishing plate 50 to the pinion shaft second end 38 without departing from the spirit and scope of the present invention. To this extent, it is recognized that inclusion of the mounting plate 48 is not necessary to accomplish the present invention. Furthermore, while the various figures illustrate up to three pinion shafts 30 with corresponding disk pulleys 42, pinions 40, mounting plates 48, and polishing plates 50, it is appreciated that more or fewer pinion shafts 30 with corresponding components may be provided without departing from the spirit and scope of the present invention. For example, in one embodiment, four pinion shafts 30 with corresponding disk pulleys 42, pinions 40, mounting plates 48, and polishing plates 50 are provided to accomplish the present invention. In another embodiment, a single pinion shaft 30 with corresponding components is provided to accomplish the improved walk behind polisher and grinder 10 of the present invention.

An internal gear 52 is mounted to the frame 14. Each pinion 40 mechanically engages the internal gear 52. An endless drive 44 is provided to allow the belt pulley 20 to mechanically communicate with each disk pulley 42. In the present embodiment, the endless drive 44 is a drive belt that frictionally connects the belt pulley 20 and each disk pulley 42 such that rotation of the central shaft 18 by the drive motor 12 causes each disk pulley 42 to rotate. The endless drive 44 also communicates with a tension pulley 46 rotatably mounted within the rotary housing 22. The tension pulley 46 is biased toward the endless drive 44 by means of a spring or other suitable device, such that the tension pulley 46 maintains tension within the endless drive 44 and contributes to the prevention of the endless drive 44 losing contact with the belt pulley 20 or the disk pulley 42. Those skilled in the art will recognize other devices suitable to achieve the endless drive 44 and the various pulleys 20, 42, such as a chain and sprocket assembly or other suitable device. Therefore, it is contemplated that such other devices can be used without departing from the spirit and scope of the present invention.

Figure 3:
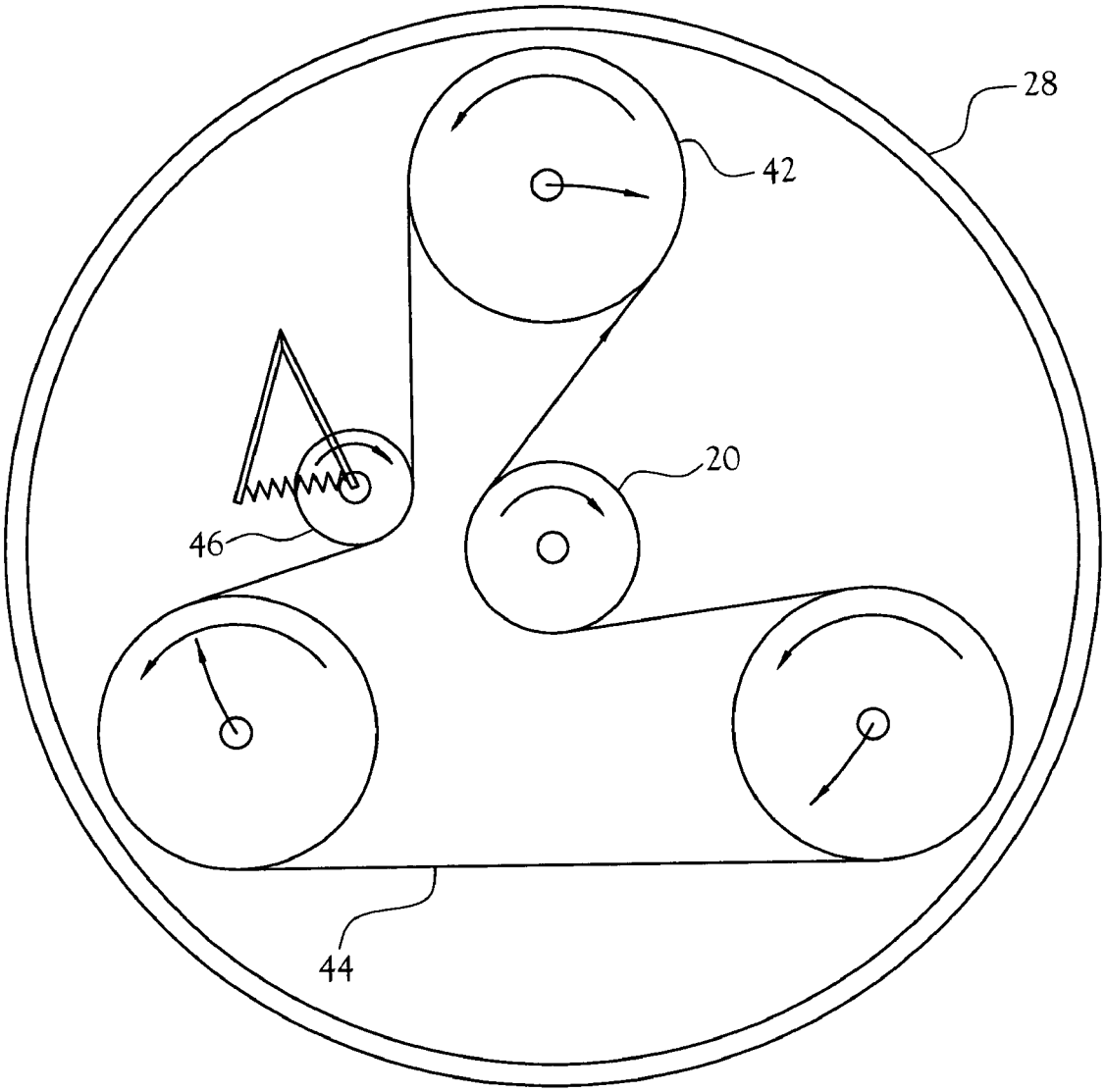
FIG. 3 is a cross-sectional plan view of the improved walk behind polisher and grinder, taken along 3—3 of FIG. 1.

FIG. 2 is a plan view showing the interaction of each pinion 40 with the internal gear 52. FIG. 3 is a cross-sectional plan view showing the interaction of the endless drive 44 with the belt pulley 20 and each disk pulley 42. As is better illustrated in FIG. 3, rotation of the central shaft 18 by the motor 12 causes rotation of the belt pulley 20 in one direction, and rotation of each disk pulley 42 in the opposite direction as the belt pulley 20. As shown in FIG. 4, the rotation of each disk pulley 42 results in the rotation of each pinion 40 and cooperating pinion shaft 30 in the same direction as the disk pulley 42. Referring to FIG. 2, in this configuration, the mechanical engagement of the internal gear 52 to each pinion 40 causes each pinion 40 and cooperating pinion shaft 30 to revolve around the central shaft 18 in a direction parallel to the rotation of the central shaft 18 and opposite the rotation of each pinion 40, the pinion shaft 30 and disk pulley 42 (see FIG. 4). This revolution of each pinion 40 and cooperating pinion shaft 30, in turn, causes the rotary housing 22 to rotate proximate the frame 14, in the same direction as the revolution of the pinion 40.

Referring to FIG. 1, in order to minimize exposure of the internal gear 52 to dust from the working surface, a baffled wall 62 is provided. In the present embodiment, the baffled wall 62 includes a bushing 58 and a brush ring 60. The bushing 58 is secured to the upper surface 24, between the upper surface 24 and the frame 14. The bushing 58 is defined by a substantially cylindrical wall which substantially surrounds the internal gear 52. The brush ring 60 is secured to the frame 14, substantially surrounding the bushing 58. The brush ring 60 is equipped with a plurality of bristles 64 which contact the bushing 58. As the upper surface 24 of the rotary housing 22 rotates proximate the frame 14, the bushing 58 rotates proximate the brush ring 60. This causes the bristles 64 to effectuate brushing of the bushing 58, limiting the exposure of the internal gear 52 to dust from the working surface. Of course, those skilled in the art will recognize that other devices and configurations are suitable to achieve the baffled wall 62 without departing from the spirit and scope of the present invention.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An improved walk behind polisher and grinder comprising:

a frame;

a drive motor for rotating a central shaft, said drive motor being mounted on said frame, said central shaft being in mechanical engagement with at least one pinion shaft to rotate said at least one pinion shaft;

at least one pinion gear connected to a corresponding said at least one pinion shaft end;

a counter spin drive comprising an internal gear fixedly mounted to said frame, said internal gear mechanically engaging said at least one pinion gear, said at least one pinion gear traveling along said internal gear for revolving said at least one pinion shaft about said central shaft, said at least one pinion shaft rotating in a first direction about said central shaft, said at least one pinion gear rotating in a second direction opposite said first direction; and, at least one surface work tool rotated by said at least one pinion shaft, each of said at least one surface work tool being mounted to a corresponding said at least one pinion shaft;

whereby said counter spin drive revolves each of said at least one pinion shaft and a cooperating one of said at least one surface work tool about said central shaft such as to resist the rotary forces resulting from each one of said at least one surface work tool.

2. The improved walk behind polisher and grinder of claim 1 further comprising:

a drive belt mechanically linking said central shaft to said at least one pinion shaft; and, a tension pulley rotatably mounted proximate said drive belt, said tension pulley being mechanically biased toward said drive belt such as to maintain tension within said drive belt.

3. An improved walk behind polisher and grinder comprising:

a drive motor for rotating a central shaft, said drive motor being mounted on a frame, said central shaft being in mechanical communication with at least one pinion shaft to rotate said at least one pinion shaft, each of said at least one pinion shaft having a first end and a second end;

a counter spin drive for revolving said at least one pinion shaft about said central shaft opposite said pinion shaft rotation, said counter spin drive comprising:

at least one pinion, each of said at least one pinion being fixed to one of said pinion shaft first ends;

at least one disk pulley, each of said at least one disk pulley being fixed to one of said at least one pinion shaft proximate said pinion shaft second end, said central shaft being in mechanical communication with said at least one disk pulley by means of an endless drive;

an internal gear mechanically engaging said at least one pinion, said internal gear being fixed proximate said frame; and, at least one polishing plate rotated by said at least one pinion shaft, each of said at least one polishing plate being mounted to one of said at least one pinion shaft;

whereby said counter spin drive revolves each of said at least one pinion shaft and cooperating polishing plates about said central shaft such as to resist the rotary forces resulting from each of said rotating polishing plates.

4. The improved walk behind polisher and grinder of claim 3 further including a rotary housing substantially surrounding said at least one disk pulley, said rotary housing comprising an upper surface and a lower surface connected by a substantially cylindrical wall, said upper surface being rotatably mounted to said central shaft and said upper surface being rotatably mounted to each of said at least one pinion shaft.

5. The improved walk behind polisher and grinder of claim 3 further comprising:

a drive belt mechanically linking said central shaft to said at least one pinion shaft; and, a tension pulley rotatably mounted proximate said drive belt, said tension pulley being mechanically biased toward said drive belt such as to maintain tension within said drive belt.

6. The improved walk behind polisher and grinder of claim 3 further including:

a drive belt mechanically linking said central shaft to said at least one disk pulley;

a rotary housing substantially surrounding said at least one disk pulley and said drive belt, said rotary housing comprising an upper surface and a lower surface connected by a substantially cylindrical wall, said upper surface being rotatably mounted to said central shaft and said upper surface being rotatably mounted to each of said at least one pinion shaft;

a tension pulley rotatably mounted within said rotary housing, said tension pulley being mechanically biased toward said drive belt such as to maintain tension within said drive belt.

7. An improved walk behind polisher and grinder comprising:

a drive motor for rotating a central shaft, said drive motor being mounted on a frame, said central shaft being in mechanical communication with at least one pinion shaft to rotate said at least one pinion shaft, each of said at least one pinion shaft having a first end and a second end;

a counter spin drive for revolving said at least one pinion shaft about said central shaft opposite said pinion shaft rotation, said counter spin drive comprising:

at least one pinion, each of said at least one pinion being fixed to one of said pinion shaft first ends;

at least one disk pulley, each of said at least one disk pulley being fixed to one of said at least one pinion shaft proximate said pinion shaft second end, said central shaft being in mechanical communication with said at least one disk pulley by means of an endless drive;

an internal gear mechanically engaging said at least one pinion, said internal gear being fixed proximate said frame; and, at least one polishing plate rotated by said at least one pinion shaft, each of said at least one polishing plate being mounted to one of said at least one pinion shaft;

a rotary housing substantially surrounding said at least one disk pulley, said rotary housing comprising an upper surface and a lower surface connected by a substantially cylindrical wall, said upper surface being rotatably mounted to said central shaft and said upper surface being rotatably mounted to each of said at least one pinion shaft; and, a baffled wall for housing said internal gear, said baffled wall substantially surrounding said internal gear;

whereby said counter spin drive revolves each of said at least one pinion shaft and cooperating polishing plates about said central shaft such as to resist the rotary forces resulting from each of said rotating polishing plates.

8. An improved walk behind polisher and grinder comprising:

a drive motor for rotating a central shaft, said drive motor being mounted on a frame, said central shaft being in mechanical communication with at least one pinion shaft to rotate said at least one pinion shaft, each of said at least one pinion shaft having a first end and a second end;

a counter spin drive for revolving said at least one pinion shaft about said central shaft opposite said pinion shaft rotation, said counter spin drive comprising:

at least one pinion, each of said at least one pinion being fixed to one of said pinion shaft first ends;

at least one disk pulley, each of said at least one disk pulley being fixed to one of said at least one pinion shaft proximate said pinion shaft second end, said central shaft being in mechanical communication with said at least one disk pulley by means of an endless drive;

an internal gear mechanically engaging said at least one pinion, said internal gear being fixed proximate said frame;

a rotary housing substantially surrounding said at least one disk pulley, said rotary housing comprising an upper surface and a lower surface connected by a substantially cylindrical wall, said upper surface being rotatably mounted to said central shaft and said upper surface being rotatably mounted to each of said at least one pinion shaft;

at least one polishing plate rotated by said at least one pinion shaft, each of said at least one polishing plate being mounted to one of said at least one pinion shaft; and, a baffled wall for housing said internal gear, said baffled wall substantially surrounding said internal gear, said baffled wall comprising:

a bushing comprising a substantially cylindrical wall, said bushing being fixed to said upper surface substantially surrounding said internal gear; and, a brush ring attached to said frame substantially surrounding said bushing, said brush ring having a plurality of bristles in substantial contact with said bushing;

whereby said counter spin drive revolves each of said at least one pinion shaft and cooperating polishing plates about said central shaft such as to resist the rotary forces resulting from each of said rotating polishing plates, and whereby upon rotation of said rotary housing proximate said frame, said bushing rotates proximate said brush ring, causing said bristles to effectuate brushing of said bushing.

9. An improved walk behind polisher and grinder comprising:

a drive motor for rotating a central shaft, said drive motor being mounted on a frame, said central shaft being in mechanical communication with at least one pinion shaft to rotate said at least one pinion shaft, each of said at least one pinion shaft having a first end and a second end;

a counter spin drive for revolving said at least one pinion shaft about said central shaft opposite said pinion shaft rotation, said counter spin drive comprising:

at least one pinion, each of said at least one pinion being fixed to one of said pinion shaft first ends;

at least one disk pulley, each of said at least one disk pulley being fixed to one of said at least one pinion shaft proximate said pinion shaft second end, said central shaft being in mechanical communication with said at least one disk pulley by means of an endless drive;

an internal gear mechanically engaging said at least one pinion, said internal gear being fixed proximate said frame;

a rotary housing substantially surrounding said at least one disk pulley, said rotary housing comprising an upper surface and a lower surface connected by a substantially cylindrical wall, said upper surface being rotatably mounted to said central shaft and said upper surface being rotatably mounted to each of said at least one pinion shaft;

at least one polishing plate rotated by said at least one pinion shaft, each of said at least one polishing plate being mounted to one of said at least one pinion shaft; and a baffled wall for housing said internal gear, said baffled wall substantially surrounding said internal gear, said baffled wall comprising:

a bushing comprising a substantially cylindrical wall, said bushing being fixed to said frame substantially surrounding said internal gear; and, a brush ring attached to said upper surface substantially surrounding said bushing, said brush ring having a plurality of bristles in substantial contact with said bushing;

whereby said counter spin drive revolves each of said at least one pinion shaft and cooperating polishing plates about said central shaft such as to resist the rotary forces resulting from each of said rotating polishing plates, and whereby upon rotation of said rotary housing proximate said frame, said brush ring rotates proximate said bushing, causing said bristles to effectuate brushing of said bushing.

10. An improved walk behind polisher and grinder comprising:

a drive motor for rotating a central shaft, said drive motor being mounted on a frame, said central shaft being in mechanical communication with at least one pinion shaft to rotate said at least one pinion shaft, each of said at least one pinion shaft having a first end and a second end;

a counter spin drive for revolving said at least one pinion shaft about said central shaft opposite said pinion shaft rotation, said counter spin drive comprising:

at least one pinion, each of said at least one pinion being fixed to one of said pinion shaft first ends;

at least one disk pulley, each of said at least one disk pulley being fixed to one of said at least one pinion shaft proximate said pinion shaft second end, said central shaft being in mechanical communication with said at least one disk pulley by means of an endless drive;

an internal gear mechanically engaging said at least one pinion, said internal gear being fixed proximate said frame;

at least one polishing plate rotated by said at least one pinion shaft, each of said at least one polishing plate being mounted to one of said at least one pinion shaft;

a drive belt mechanically linking said central shaft to said at least one disk pulley;

a rotary housing substantially surrounding said at least one disk pulley and said drive belt, said rotary housing comprising an upper surface and a lower surface connected by a substantially cylindrical wall, said upper surface being rotatably mounted to said central shaft and said upper surface being rotatably mounted to each of said at least one pinion shaft;

a tension pulley rotatably mounted within said rotary housing, said tension pulley being mechanically biased toward said drive belt such as to maintain tension within said drive belt; and, a baffled wall substantially surrounding said internal gear, said baffled wall comprising:

a bushing comprising a substantially cylindrical wall, said bushing being fixed to said upper surface substantially surrounding said internal gear; and, a brush ring attached to said frame substantially surrounding said bushing, said brush ring having a plurality of bristles in substantial contact with said bushing;

whereby said counter spin drive revolves each of said at least one pinion shaft and cooperating polishing plates about said central shaft such as to resist the rotary forces resulting from each of said rotating polishing plates, and whereby upon rotation of said rotary housing proximate said frame, said bushing rotates proximate said brush ring, causing said bristles to effectuate brushing of said bushing.

11. An improved walk behind polisher and grinder comprising:

a frame;

a drive motor shaft having a first end and a second end;

a drive motor mounted to said frame, said drive motor connected to said drive motor shaft proximate to said drive motor shaft first end, said drive motor rotating said drive shaft;

a drive pulley connected to said drive motor shaft proximate to said drive motor shaft second end, said drive pulley rotating as said drive shaft rotates;

at least one pinion shaft having a first end and a second end;

a pinion pulley connected to each said at least one pinion shaft proximate to each said at least one pinion shaft second end;

an internal gear fixedly mounted to said frame;

a drive belt in frictional engagement with each said pinion pulley and said drive pulley, said drive belt imparting rotational movement in a first direction to each said at least one pinion shaft;

a pinion gear connected to each said at least one pinion shaft proximate to each said at least one pinion shaft first end, each said pinion gear operatively engaging said internal gear to move each said at least one pinion shaft about said internal gear in an second direction, said second direction being opposite to said first direction, said second direction resulting in an orbital rotation of each said at lest one pinion shaft about said central shaft; and a surface work tool connected to each said at least one pinion shaft proximate to each said pinion shaft at least one second end, said surface work tool rotating with said at least one pinion shaft.

12. The improved walk behind polisher and grinder of claim 11 further comprising:

a rotary housing comprising an upper surface and a lower surface connected by a substantially cylindrical wall, said rotary housing substantially surrounding said drive pulley and said drive belt and each said pinion pulley, said upper surface being mounted to said drive motor shaft, said upper surface rotably mounted to each said at least one pinion shaft, said lower surface being rotatably mounted to each said pinion pulley.

13. An improved walk behind polisher and grinder comprising:

a frame;

a drive motor shaft having a first end and a second end;

a drive motor mounted to said frame, said drive motor connected to said drive motor shaft proximate to said drive motor shaft first end, said drive motor rotating said drive shaft;

a drive pulley connected to said drive motor shaft proximate to said drive motor shaft second end, said drive pulley rotating as said drive shaft rotates;

at least one pinion shaft having a first end and a second end;

a pinion pulley connected to each said at least one pinion shaft proximate to each said at least one pinion shaft second end;

an internal gear fixedly mounted to said frame;

a drive belt in frictional engagement with each said pinion pulley and said drive pulley, said drive belt imparting rotational movement in a first direction to each said at least one pinion shaft;

a pinion gear connected to each said at least one pinion shaft proximate to each said at least one pinion shaft first end, each said pinion gear operatively engaging said internal gear to move each said at least one pinion shaft about said internal gear in an second direction, said second direction being opposite to said first direction, said second direction resulting in an orbital rotation of each said at lest one pinion shaft about said central shaft;

a surface work tool connected to each said at least one pinion shaft proximate to each said pinion shaft at least one second end, said surface work tool rotating with said at least one pinion shaft;

a rotary housing comprising an upper surface and a lower surface connected by a substantially cylindrical wall, said rotary housing substantially surrounding said drive pulley and said drive belt and each said pinion pulley, said upper surface being mounted to said drive motor shaft, said upper surface rotably mounted to each said at least one pinion shaft, said lower surface being rotatably mounted to each said pinion pulley;

a bushing comprising a substantially cylindrical wall, said bushing being mounted to said upper surface of said rotary housing, said bushing substantially surrounding said internal gear to prevent dust from interacting with said internal gear; and, a brush ring fixedly mounted to said frame, said brush ring substantially surrounding said bushing, said brush ring having a plurality of bristles in substantial contact with said bushing to effectuate brushing of said bushing upon rotation of said bushing.

* * * * *